US010072347B2

(12) United States Patent
Woodrow

(10) Patent No.: US 10,072,347 B2
(45) Date of Patent: Sep. 11, 2018

(54) SYSTEMS AND METHODS FOR TIN ANTIMONY PLATING

(71) Applicant: The Boeing Company, Chicago, IL (US)

(72) Inventor: Thomas A. Woodrow, Lakeside, TX (US)

(73) Assignee: THE BOEING COMPANY, Chicago, IL (US)

( * ) Notice: Subject to any disclaimer, the term of this patent is extended or adjusted under 35 U.S.C. 154(b) by 524 days.

(21) Appl. No.: 13/646,401

(22) Filed: Oct. 5, 2012

(65) Prior Publication Data

US 2014/0209468 A1 Jul. 31, 2014

Related U.S. Application Data

(60) Provisional application No. 61/677,908, filed on Jul. 31, 2012.

(51) Int. Cl.

| | |
|---|---|
| ***C25D 3/60*** | (2006.01) |
| ***C25D 3/32*** | (2006.01) |
| ***C25D 21/02*** | (2006.01) |

(52) U.S. Cl.

CPC ..... *C25D 3/60* (2013.01); *C25D 3/32* (2013.01); *C25D 21/02* (2013.01)

(58) Field of Classification Search

CPC ..... C25D 3/32; C25D 3/60
USPC ..... 205/50, 252, 253
See application file for complete search history.

(56) References Cited

U.S. PATENT DOCUMENTS

| | | | | |
|---|---|---|---|---|
| 2,825,683 | A | 3/1958 | Lowenheim et al. | |
| 3,821,094 | A * | 6/1974 | Kampe | C25D 3/32 205/304 |
| 4,027,055 | A * | 5/1977 | Schneble, Jr. | 205/85 |
| 4,347,107 | A * | 8/1982 | Teichmann et al. | 205/241 |
| 4,959,278 | A | 9/1990 | Shimauchi et al. | |
| 5,282,953 | A | 2/1994 | Gernon et al. | |
| 5,393,573 | A | 2/1995 | MacKay | |
| 6,179,935 | B1 * | 1/2001 | Yamashita et al. | 148/400 |
| 6,773,568 | B2 * | 8/2004 | Egli | C25D 3/30 205/122 |
| 6,860,981 | B2 | 3/2005 | Schetty, III et al. | |
| 7,160,629 | B2 | 1/2007 | Crosby | |

(Continued)

FOREIGN PATENT DOCUMENTS

| | | |
|---|---|---|
| EP | 1 978 051 A1 | 10/2008 |
| GB | 1 170 391 A | 11/1969 |

(Continued)

OTHER PUBLICATIONS

Samel, M. "The electrodeposition of tin and lead-tin based alloys", M.A.F Samel, 1984, https://dspace.lboro.ac.uk/2134/11174.*

(Continued)

*Primary Examiner* — Brian W Cohen
(74) *Attorney, Agent, or Firm* — MH2 Technology Law Group LLP

(57) ABSTRACT

Systems and methods for tin antimony plating are provided. One plating method includes doping a tin (Sn) plating solution with antimony (Sb). One method also includes electroplating a component using the antimony-doped tin plating. The antimony-doped tin plating formed by one method includes between about 1% and about 3% antimony.

5 Claims, 5 Drawing Sheets

(56) References Cited

U.S. PATENT DOCUMENTS

| | | | | |
|---|---|---|---|---|
| 2003/0066756 | A1* | 4/2003 | Gabe et al. | 205/296 |
| 2004/0253804 | A1* | 12/2004 | Beica | C25D 3/60 438/614 |
| 2007/0007144 | A1 | 1/2007 | Schetty, III | |
| 2007/0295530 | A1 | 12/2007 | Jackson et al. | |
| 2008/0050611 | A1 | 2/2008 | Kwok et al. | |
| 2008/0269395 | A1* | 10/2008 | Reddington et al. | 524/440 |

FOREIGN PATENT DOCUMENTS

| | | | |
|---|---|---|---|
| JP | S57140882 | A | 8/1982 |
| JP | H08-296050 | A | 11/1996 |
| JP | H08296050 | A | 11/1996 |
| JP | 20000080493 | A | 3/2000 |
| JP | 2008248348 | A | 10/2008 |

OTHER PUBLICATIONS

Abd et al. "Electroplating of antimony and antimony-tin alloys" Journal of Applied Electrochemistry 17 (1987) 156-164.*
Triton QS-15 product information, 2009.*
R. Kawanaka, K. Fujiwara, S. Nango and T. Hasegawa, Influence of Impurities on the Growth of Tin Whiskers, Japanese Journal of Applied Physics, Part. 1, vol. 22, No. 6, Jun. 1983, pp. 917-922.
International Search Report, International Application No. PCT/US2013/045921, dated Nov. 7, 2013, (5) pgs.
K. Fujiwara, et al., Interfacial Reaction in Bimetallic Sn/Cu Thin Films, Thin Solid Films, 70 (1980) 153-161.
K. Tomoyuki, et al., Grain Size Effect of Electro-Plated Tin Coatings on Whisker Growth, Journal of Materials Science 17 (1982) 2560-2566.
S.M. Arnold, Repressing the Growth of Tin Whiskers, Plating, vol. 53, 1956, pp. 96-99.
Jay A. Brusse, et al., Tin Whiskers: Attributes and Mitigation, 22nd Capacitor and Resistor Technology Symposium Proceedings, Mar. 25-29, 2002, pp. 67-80.
S.C. Britton, Spontaneous Growth of Whiskers on Tin Coating: 20 Years of Observation, Transactions of the Institute of Metal Finishing, vol. 52, 1974, pp. 95-102.
P.L. Key, Surface Morphology of Whisker Crystals of Tin, Zinc and Cadmium, IEEE 20th Electronic Components Conference Proceedings, May 1970, pp. 155-160.
V.K. Glazunova and N.T. Kudryavtsev, an Investigation of the Conditions of Spontaneous Growth of Filiform Crystals on Electrolytic Coatings, J. of Applied Chemistry of the USSR (translated from Zhurnal Prikladnoi Khimii), vol. 36, No. 3, Mar. 1963, pp. 519-525.
Cpt M.E. McDowell, Tin Whiskers: A Case Study, Aerospace App. Conf., 1993, pp. 207-215.
B.-Z. Lee and D.N. Lee, Spontaneous Growth Mechanism of Tin Whiskers, Acta Met., vol. 46, No. 10, 1998, pp. 3701-3714.
Dr. G.T. Galyon, Annotated Tin Whisker Bibliography, NEMI, Feb. 2003, pp. 1-21.
B.D. Dunn, Whisker Formation on Electronic Materials, Circuit World, vol. 2, No. 4, Jul. 1976, pp. 32-40.
D. Endicott and K.T. Kisner, A Proposed Mechanism for Metallic Whisker Growth, Proceedings of the AESF SUR/FIN Conference, Jul. 1984, pp. 1-20.
N. Furuta and K. Hamamura, Growth Mechanism of Proper Tin-Whisker, Journal of Applied Physics, vol. 8, No. 12, Dec. 1969, pp. 1404-1410.
U. Lindborg, A Model for the Spontaneous Growth of Zn, Cd and Sn Whiskers, Acta Met., vol. 24, 1976, pp. 181-186.
A. Selcuker and M. Johnson, Microstructural Charactorization of Electrodeposited Tin Layer in Relation to Whisker Growth, Capacitor and Resistor Technology Symposium Proceedings, Oct. 1990, pp. 19-22.
M. Endo, S. Higuchi, Y. Tokuda and Y. Sakabe, Elimination of Whisker Growth on Tin Plated Electrodes, Proceedings of the 23rd International Symposium for Testing and Failure Analysis, Oct. 27-31, 1997, pp. 305-3111.
Johnson, Christopher, "Alloy Films Deposited by Electroplating as Precursors for Protective Oxide Coatings on Solid Oxide Fuel Cells Metallic Interconnect Materials", Fuel Cells and Energy Storage Systems: Materials, Processing, Manufacturing and Power Management Technologies; Materials Science and Technology (MS&T) 2006: Materials and Systems—vol. 1; 7 pgs.
Japanese Office Action dated Jun. 6, 2017 in Application No. JP 2015-525425, 5 pages.
European Office Action dated Dec. 14, 2017 in corresponding European Application No. 13731242.7.
Medvedev et al., "Microdistribution in Electrodeposition of Tin-Antimony Alloy from Sulfate Electrolytes with Organic Additives," Russian Journal of Applied Chemistry, vol. 74, No. 11, Jan. 1, 2001, pp. 1817-1820.
Medvedev et al., "Electrodeposition of Tin-Antimony Alloy from Sulfate Electrolytes with Organic Additives," Russian Journal of Applied Chemistry translated from Zhurnal Prikladnoi Khimii, vol. 74, No. 9, Jan. 1, 2001, pp. 1465-1469.

* cited by examiner

200

| Plating | ICP Analysis (First Coupon) | ICP Analysis (Last Coupon) | Plating Thickness (Microns) (from FIB) (206) | Roughness as Plated (Ra) (nm) (202) | Roughness as Plated (TIR) (nm) (204) | Ave.Grain Size (Microns) (208) | Grain Morphology (210) |
|---|---|---|---|---|---|---|---|
| | | | | | | | |
| Sn | | | 4.9 | 105 | 725 | 2.88 | Columnar |
| | | | | | | | |
| SnSb | 2.4% Sb | 2.2% Sb | 2.6 to 6.0 | 520 | 2810 | 0.78 | Columnar |
| | | | | | | | |

300

400

500

600

SYSTEMS AND METHODS FOR TIN ANTIMONY PLATING

CROSS-REFERENCE TO RELATED APPLICATIONS

This application claims priority to and the benefit of the filing date of U.S. Provisional Application No. 61/677,908, filed on Jul. 31, 2012, entitled "Systems and Methods for Tin Antimony Plating," which is hereby incorporated by reference in its entirety.

STATEMENT REGARDING FEDERALLY SPONSORED RESEARCH AND DEVELOPMENT

This invention was made with government support under U.S. Government Contract Number W912HQ-10-C-0022 awarded by the Department of the Army, Office of the U.S. Army Corps of Engineers. The U.S. Government has certain rights in the invention.

BACKGROUND

The present disclosure relates generally to metal plating, particularly to tin platings.

The transition to lead-free electronics is resulting in suppliers of electronic components converting product lines from tin/lead to lead-free finishes. The suppliers often use pure electroplated tin as a lead-free finish. However, pure tin platings have a propensity to form tin whiskers. For example, tin whiskers have been found to form on a wide variety of tin-plated component types under a range of environmental conditions. These whiskers are comprised of nearly pure tin and are therefore electrically conductive and can cause shorting of electronics. The growth of whiskers has caused, and continues to cause, reliability problems for electronic systems that employ components that are plated with tin, which includes, for example, manufacturers of high-reliability systems and government users. Moreover, field failures attributable to tin whiskers can cost millions of dollars and result in customer dissatisfaction.

The factors that cause tin whiskers to grow are not well understood, although stress in the plating is believed to be a key factor. The effects of plating process parameters such as current density, temperature, substrate preparation, substrate material, and bath components have been studied. In addition, the effects of plating thickness, underlayers, post-plating annealing, plating structure, and alloying agents on whisker growth have been explored. The crystallographic structure of tin whiskers has also been studied.

Thus, with respect to the issue of tin whisker growth, while it would be desirable to remove pure tin from an electronic system, increasing use of tin by electronic component vendors and the increasing use of COTS (commercial-off-the-shelf) components in high-reliability systems makes such removal difficult to implement.

Another approach includes dipping all tin-plated component leads into molten tin/lead (up to the component body). However, this can damage the component package which allows intrusion of moisture into the package. In addition, the dipping operation is expensive.

Thus, known methods for controlling tin whisker growth can be difficult to implement and/or can result in adverse effects.

SUMMARY

In accordance with one embodiment, a plating method is provided. The method includes doping a tin (Sn) plating solution with antimony (Sb) and electroplating a component using the antimony-doped tin plating.

In accordance with another embodiment, a method for tin plating a component is provided. The method includes producing an electrolyte by dissolving tin sulfate in deionized water, filtering the tin sulfate solution to obtain a clear solution that becomes cloudy upon sitting, stirring into the cloudy solution an amount of sulfuric acid to provide a clear solution, stirring a surfactant into the solution, stirring a formaldehyde solution into the solution, stirring a benzyl alcohol into the solution to obtain a clear, colorless solution and heating the solution to about 75° C. in a water bath. The method also includes preparing an antimony solution by dissolving an amount of antimony powder in sulfuric acid with heating and stirring and adding an amount of the antimony solution to the electrolyte being maintained at about 75° C.

The features, functions, and advantages that have been discussed can be achieved independently in various embodiments or may be combined in yet other embodiments, further details of which can be seen with reference to the following description and drawings.

DETAILED DESCRIPTION

Figure 1A:
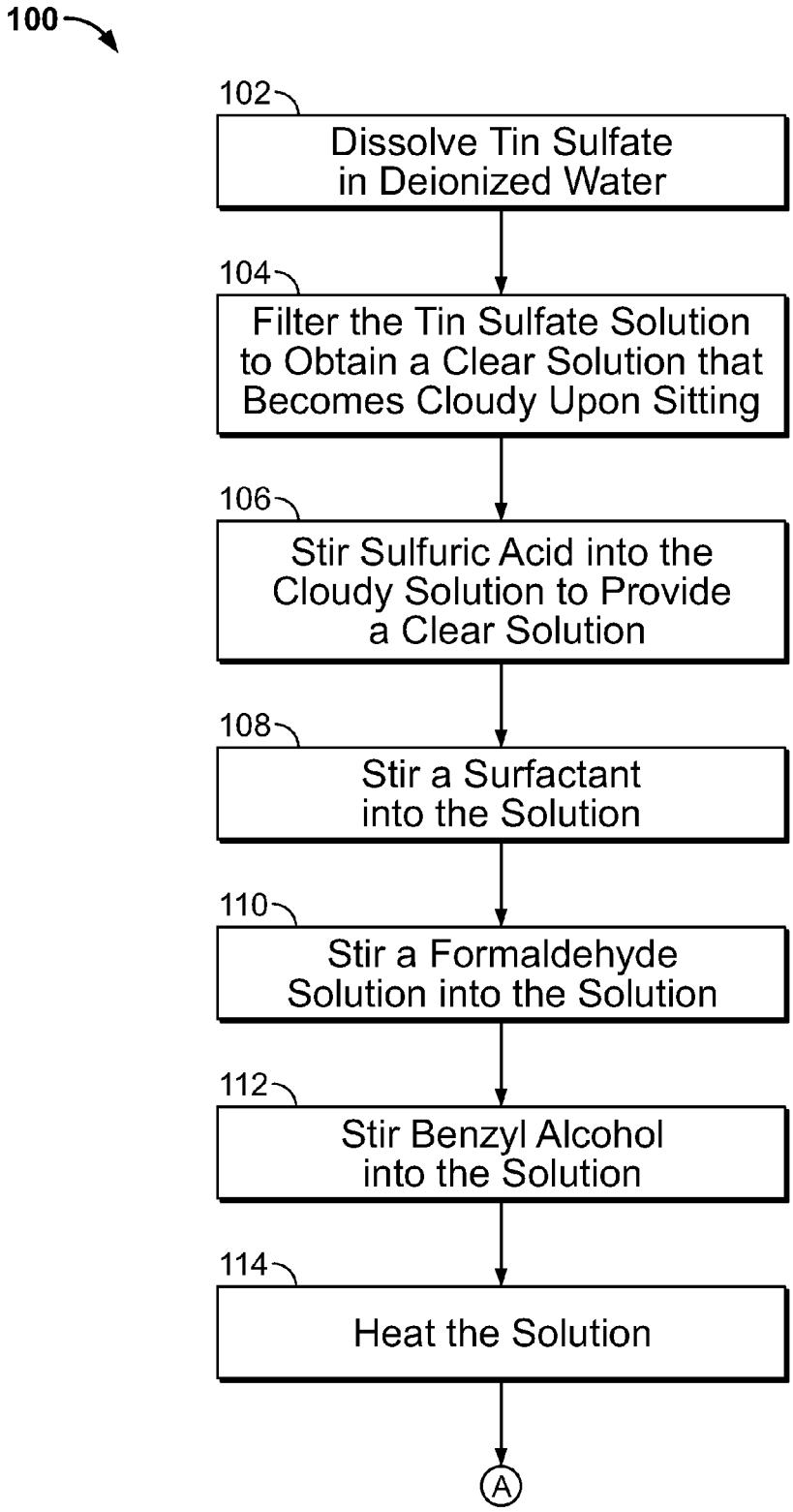
FIGS. 1A and 1B are illustrations of operations performed by various embodiments for providing tin plating.

The following detailed description of certain embodiments will be better understood when read in conjunction with the appended drawings. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Various embodiments described and/or illustrated herein provide systems and methods for tin plating that may be used, for example in electronics, and that reduces or prevents the growth of tin whiskers after plating. Some embodiments include the addition of antimony to pure tin platings to suppress whisker growth. The various embodiments may be used, for example, in electronics for different applications, such as land, air, sea and space applications (e.g., aerospace or commercial electronics). For example, one or more embodiments may be used in medical applications (e.g., heart pacemakers), military applications (e.g., radar systems or missiles), space applications (e.g., satellites) or energy applications (e.g., nuclear energy systems). However, the various embodiments may be used in other applications that include components (e.g., electrical components, such as relays) with tin plating.

It should be noted that although the various embodiments include methods and processes that use particular parameters, such as particular temperatures, plating thicknesses, amounts of materials used, timing, as well as other parameters, these parameters may be varied.

Various embodiments provide a method for producing an electroplate containing tin (Sn) and antimony (Sb). For example, some embodiments described herein dope tin with antimony, such as to put antimony into tin to reduce or prevent whisker formation in the tin antimony plating. In one embodiment, the electroplating contains antimony that can be any value or range of values between 1% to 3%. For example, the electroplating may contain in one particular embodiment, 97.6% tin and 2.4% antimony. In another embodiment, the antimony content can be any value or range of values up to 5%. In yet another embodiment, the antimony content can vary below 1% and above 5%. In still other embodiments, the antimony content is less than about 3%. Thus, while different examples are described below, these examples are presented for the non-limiting purpose of further illustrating various embodiments.

Figures 1B, 2:
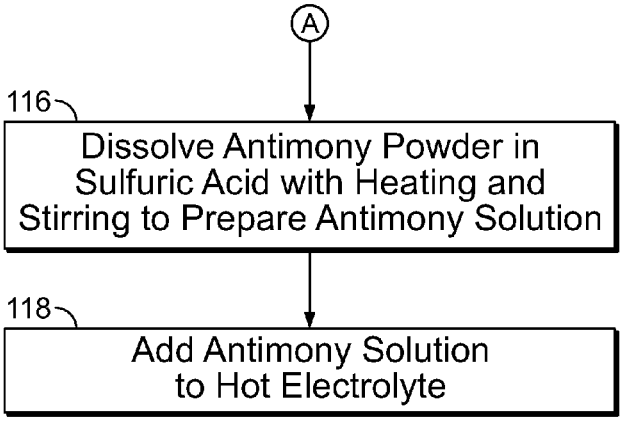
FIG. 2 is a table of plating results in accordance with various embodiments.

Various embodiments provide a plating method 100 as illustrated in FIGS. 1A and 1B. The plating method 100 may be used for doping tin platings with, for example, about 1% to about 3% of antimony. However, the method 100 may be modified to produce platings with more or less antimony content. Additionally, the method 100 may employ structures or aspects of different embodiments discussed. In various embodiments, certain steps may be omitted or added, certain steps may be combined, certain steps may be performed simultaneously, or concurrently, certain steps may be split into multiple steps, certain steps may be performed in a different order, or certain steps or series of steps may be re-performed in an iterative fashion.

In one embodiment, the method 100 provides an electroplating bath for tin plating that produces an electrolyte. The method 100 generally includes dissolving tin sulfate in deionized water at 102. For example in one embodiment, 1.50 grams of tin (II) sulfate (e.g., 99.6%, available from Alfa Aesar) is dissolved in 30 milliliters of deionized water. In other embodiments, the amount of tin sulfate may be increased or decreased to have a value or range of values above or below about 1.50 grams, such as between 1 to 3 grams. In still other embodiments, the tin sulfate has a value or range of values up to 5 grams. In yet other embodiments, higher or lower amounts or ranges of amounts of tin sulfate below 1 gram and above 5 grams may be used. Additionally, the amount of deionized water may be greater than or less than about 30 milliliters. It should be noted that the dissolving of the tin sulfate may be performed using any suitable process in the art.

The method 100 also includes at 104 filtering the tin sulfate solution to obtain a clear solution that becomes cloudy upon sitting (e.g., after a determined or defined period of time). In one embodiment, the solution having the dissolved and/or suspended tin sulfate is filtered through filter paper (e.g., Whatman No. 1 filter paper) to obtain a clear solution that becomes cloudy upon sitting.

The method 100 also includes stirring sulfuric acid into the cloudy solution at 106 to provide a clear solution. For example, in one embodiment, 1.30 grams of concentrated sulfuric acid (e.g., 98%, ACS Reagent, available from Integra Chemical) is added to the solution with stirring to obtain a clear solution. In other embodiments, the amount of sulfuric acid may be increased or decreased to have a value or range of values above or below about 1.30 grams, such as between 1 to 3 grams. In still other embodiments, the added sulfuric acid has a value or range of values up to 5 grams. In yet other embodiments, higher or lower amounts or ranges of amounts of sulfuric acid below 1 gram and above 5 grams may be used. Additionally, the concentration level of the sulfuric acid may be varied, such as above or below 98%.

The method 100 further includes stirring a surfactant into the solution at 108. For example, 0.0609 grams of Triton X-100 (available from Dow Chemical) is dissolved in the above described electrolyte with stirring. However, other types and kinds of surfactants may be used. For example, in other embodiments, different types of nonionic surfactants may be used. Additionally, different amounts of the surfactant may be stirred into the solution, such as between 0.01 and 0.1 grams of Triton X-100. In other embodiments, the amount may be less than 0.01 grams or more than 0.1 grams.

The method 100 additionally includes stirring a formaldehyde solution at 110 into the solution prepared as described above. For example, in one embodiment, 0.198 grains of 37% formaldehyde solution (available from Alfa Aesar) is dissolved in the above electrolyte with stirring. In other embodiments, the amount of formaldehyde solution may be increased or decreased to have a value or range of values above or below about 0.198 grams, such as between 0.01 to 0.3 grams. In still other embodiments, the added formaldehyde solution has a value or range of values up to 0.5 grams. In yet other embodiments, higher or lower amounts or ranges of amounts of formaldehyde solution below 0.01 grams and above 0.5 grams may be used. Additionally, the concentration level of the formaldehyde solution may be varied, such as above or below a 37% formaldehyde solution, for example, between 25% and 50%.

The method 100 also includes stirring benzyl alcohol into the solution at 112. For example, in one embodiment, 0.182 grams of benzyl alcohol (available from ACS Reagent, Integra Chemical) is dissolved in the above electrolyte with vigorous stirring to obtain a clear, colorless solution. In other embodiments, the amount of benzyl alcohol may be increased or decreased to have a value or range of values above or below about 0.182 grams, such as between 0.01 to 0.3 grams. In still other embodiments, the added benzyl alcohol has a value or range of values up to 0.5 grams. In yet other embodiments, higher or lower amounts or ranges of amounts of benzyl alcohol below 0.01 grams and above 0.5 grams may be used.

The method 100 includes heating the solution at 114. For example, in one embodiment, the electrolyte solution produced as described above is heated in a water bath having a temperature of 75° C. However, in other embodiments, the temperature is about 75° C. In still other embodiments, the temperature has a value or range of values between 70° C. and 80° C. In still other embodiments, the temperature has a value or range of values below 70° C. or above 80° C.

The method includes dissolving antimony powder in sulfuric acid with heating and stirring at 116 to prepare an antimony solution. For example, in one embodiment, a solution of antimony trisulfate $Sb_2(SO_4)_3$ is prepared by dissolving 0.0431 grams of antimony powder (e.g., −325 mesh, 99.5%, available from Alfa Aesar) in 8.1 grams of concentrated sulfuric acid (98%, ACS Reagent, available from Integra Chemical) with heating and stirring, such as heating and stirring methods in the art, which may include heating at different temperatures. In other embodiments, the amount of antimony powder may be increased or decreased to have a value or range of values above or below about 0.0431 grams, such as between 0.01 to 0.1 grams and the amount of sulfuric acid may be increased or decreased to have a value or range of values above or below about 8.1 grams, such as between 5 and 10 grams. In still other embodiments, the amount of antimony powder may be increased or decreased to have a value or range of values between 0.01 to 0.3 grams and the amount of sulfuric acid may be increased or decreased to have a value or range of values between 1 and 20 grams. In yet other embodiments, higher or lower ranges of antimony powder below 0.01 grams and above 0.3 grams and higher or lower ranges of sulfuric acid below 1 gram and above 20 grams may be used. Additionally, the concentration level of the sulfuric acid may be varied, such as above or below 98%.

The method includes adding the antimony solution to the electrolyte at 118. For example, in one embodiment, 1.40 grams of a hot $Sb_2(SO_4)_3$ solution is added dropwise with stirring to the hot tin (II) sulfate electrolyte prepared as described above while maintaining the temperature at 75° C. In other embodiments, the amount of $Sb_2(SO_4)_3$ solution may be increased or decreased to have a value or range of values above or below about 1.40 grams, such as between 1 to 3 grams. In still other embodiments, the added $Sb_2(SO_4)_3$ solution has a value or range of values up to 5 grams. In yet other embodiments, higher or lower amounts or ranges of amounts of $Sb_2(SO_4)_3$ solution below 1 gram and above 5 grams may be used. Also, in various embodiments, the temperature is at about 75° C. In other embodiments, the temperature is at a value or range of values above or below 75° C.

Using the electrolyte with the added antimony such as prepared as described in the various examples above, a tin doped with about 1% to about 3% of antimony may be provided for a tin antimony plating in one or more embodiments. However, other percentages of antimony-doped in tin may be provided, such as between about 2% to about 3% in some embodiments, or less than about 3% in other embodiments.

For example, in some embodiments, plating may be conducted (e.g., immediately conducted) using 30 milliliters of the above described electrolyte at 71° C. in a 50 milliliter glass beaker with stirring. However, in other embodiments the value or ranges of values of electrolyte may be between about 10 milliliters to about 50 milliliters. In still other embodiments, the value or ranges of values of electrolyte solution may be below 10 milliliters or above 50 milliliters. Also, the temperature may have a value or range of values between 65° C. and 75° C. in some embodiments. In still other embodiments the temperature may have a value below 65° C. or above 75° C.

Thus, it should be appreciated that the plating parameters described herein are merely exemplary and different parameters may be used to create antimony-doped tin plating as described herein.

As one example of various embodiments, an anode may be constructed from a SnSb sheet (17.9% antimony). However, the percentage of antimony in the sheet may have a different value or range of values, such as between 15% and 25%. In other embodiments, the value or range of values of the antimony content may be below 15% or above 25%. In particular, in one example, coupons (cathodes) that were electroplated were 1 cm. by 2.54 cm. in area and had a thickness of 0.041 cm. The cathodes were sheared from a Copper 110 sheet that was polished on one side. Immediately before plating, each copper coupon was cleaned with detergent and dipped into 10% sulfuric acid for 15 seconds to remove the oxide layer. Plater's tape was then used to mask each coupon so that only a 1 cm. by 1 cm. area was plated.

The anode used for electroplating the doped tin samples was 2 $cm^2$ in area (twice the area of a single copper cathode). In this example, the specimens were electroplated using an HP6033A DC power supply in series with a Keithly 175 Autoranging Multimeter (for monitoring amperage). The amperage used during the electroplating was adjusted manually to maintain a constant current density. It should be noted that other systems for electroplating may be used, such as a potentiostat.

The electroplating bath may be prepared or made, for example, as described in the method 100 and using the following parameters:

Dissolve 1.50 grams of tin (II) sulfate (99.6%) in 30 milliliters of deionized water. Filter through Whatman No. 1 filter paper to obtain a clear solution that becomes cloudy upon sitting.

Add 1.30 grams of concentrated sulfuric acid (98%) to the above solution with stirring to obtain a clear solution.

Dissolve 0.0609 grams of Triton X-100 (Dow Chemical) in the above electrolyte with stirring.

Dissolve 0.198 grams of 37% formaldehyde solution in the above electrolyte with stiffing.

Dissolve 0.182 grams of benzyl alcohol in the above electrolyte with vigorous stirring to obtain a clear, colorless solution.

Heat the above electrolyte to 75° C. in a water bath.

Prepare a solution of $Sb_2(SO_4)_3$ by dissolving 0.0431 grams of antimony powder (−325 mesh, 99.5%) in 8.1 grams of concentrated sulfuric acid (98%) with heating and stirring. Add 1.40 grams of this hot $Sb_2(SO_4)_3$ solution dropwise with stirring to the hot tin (II) sulfate electrolyte prepared above while maintaining the temperature at 75° C.

In this example, the plating was immediately conducted using 30 milliliters of the above electrolyte at 71° C. in a 50 milliliter glass beaker with stirring. The anode was constructed from the SnSb sheet (17.9% antimony). Two coupons were plated at a time (total surface area=2 $cm^2$). The plating was performed at 0.175 V and 22 milliamps for 6 minutes to yield a gray matte plating. The SnSb anode was cleaned using 500 grit SIC paper before each set of samples was plated.

The first and seventh specimens to be plated were analyzed by ICP spectroscopy to determine the percentage of dopant and consistency of the plating process. The ICP results for this example are shown in the table 200 of FIG. 2.

Typically, the platings were completely dissolved off the coupons using 8 mls of 1:1 nitric acid plus 4 mls of hydrochloric acid in a small beaker. This solution was then transferred to a 100 ml volumetric flask, diluted to volume with DI water, and analyzed for the elements of interest using the ICP spectrometer. The surface roughness of the plating was measured using a KLA-Tencor Alpha-Step 200 profilometer. The average surface roughness (Ra) and the maximum trough to peak roughness (TIR) were measured (as shown in columns 202 and 204 of table 200).

The plating thicknesses and grain morphologies were determined using focused ion beam (FIB) microsections and the average grain sizes were determined using electron backscatter diffraction (EBSD) (as shown in columns 206, 208 and 210 of table 200). Immediately after plating, the test specimens were put into a 50 degree C./50% relative humidity chamber to accelerate whisker formation and growth. Specimens plated with pure tin were also put into the test chamber for use as a control.

Figure 3:
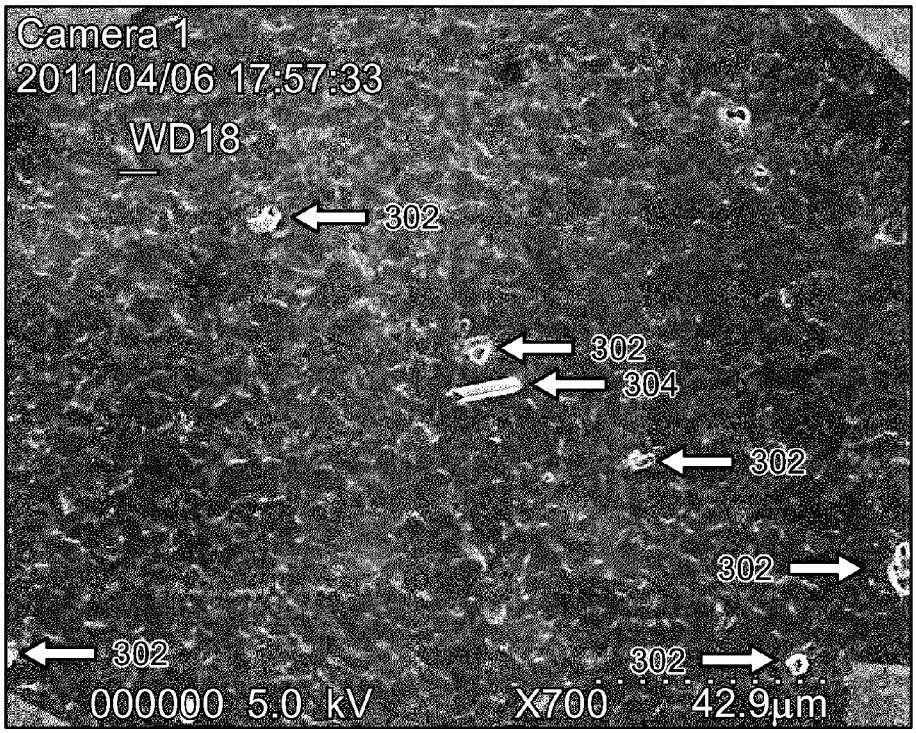
FIGS. 3 and 4 are images illustrating tin platings showing whiskers and nodules.
Figure 4:
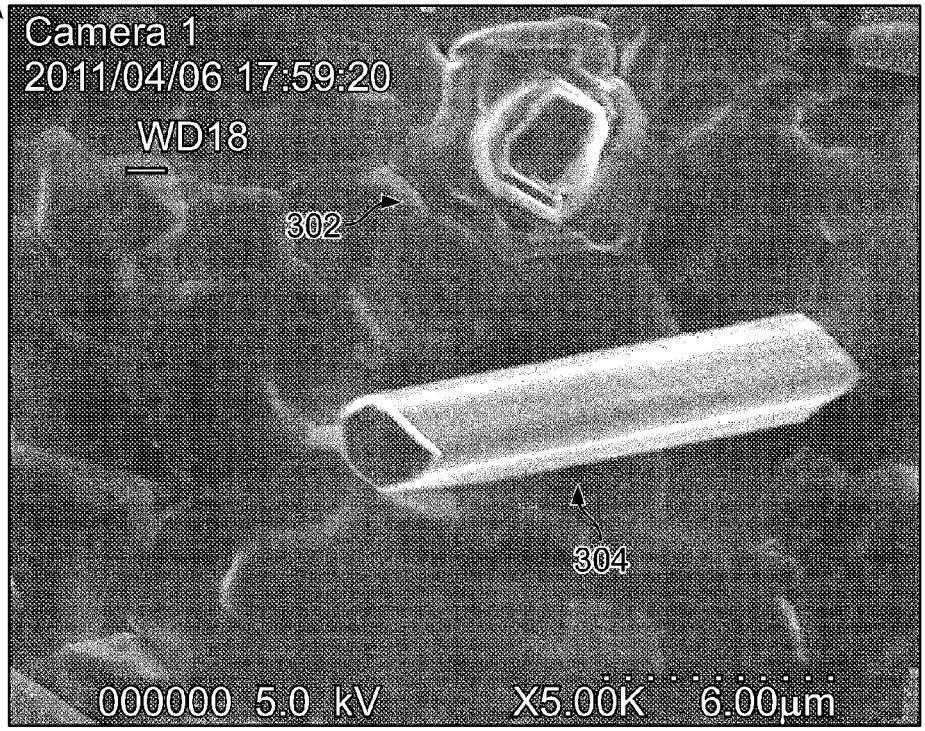
Figure 5:
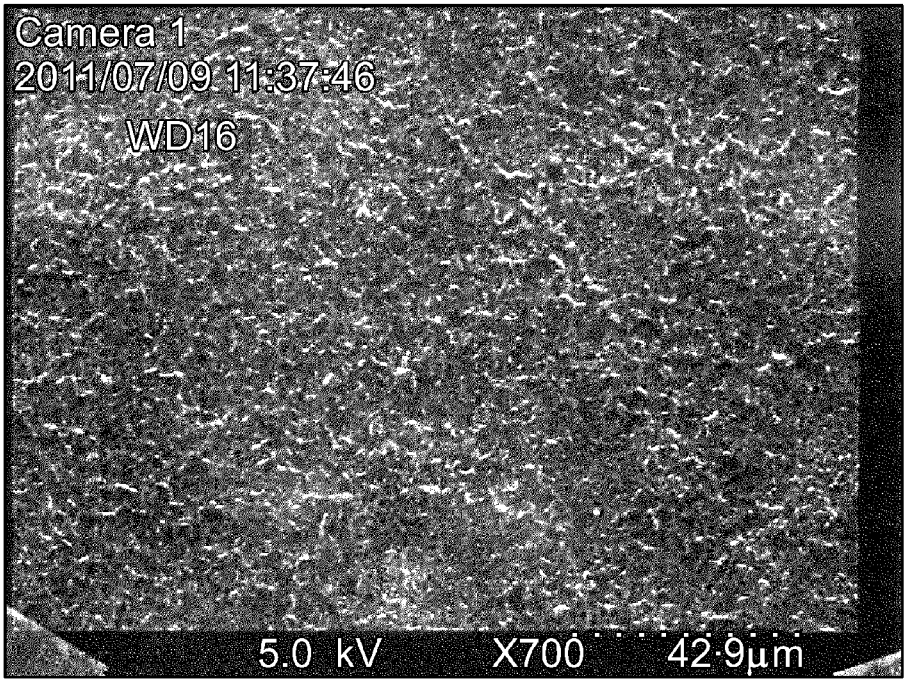
FIG. 5 is an image of tin antimony plating in accordance with one embodiment showing no whiskers or nodules.

After approximately 6 months in the chamber, the test specimens were examined using a scanning electron microscope. The pure tin platings had numerous nodules 302 and short whiskers 304 growing thereon as shown in images 300 and 400 of FIGS. 3 and 4. In contrast, the tin platings doped with 2.4% of antimony were free from whiskers and nodules (as shown in the image 500 of FIG. 5).

Accordingly, using one or more embodiments to add amounts of antimony to tin platings (e.g., small amounts of antimony, such as between 1% and 3%) had the unexpected result of reducing or eliminating tin whisker formation.

Figure 6:
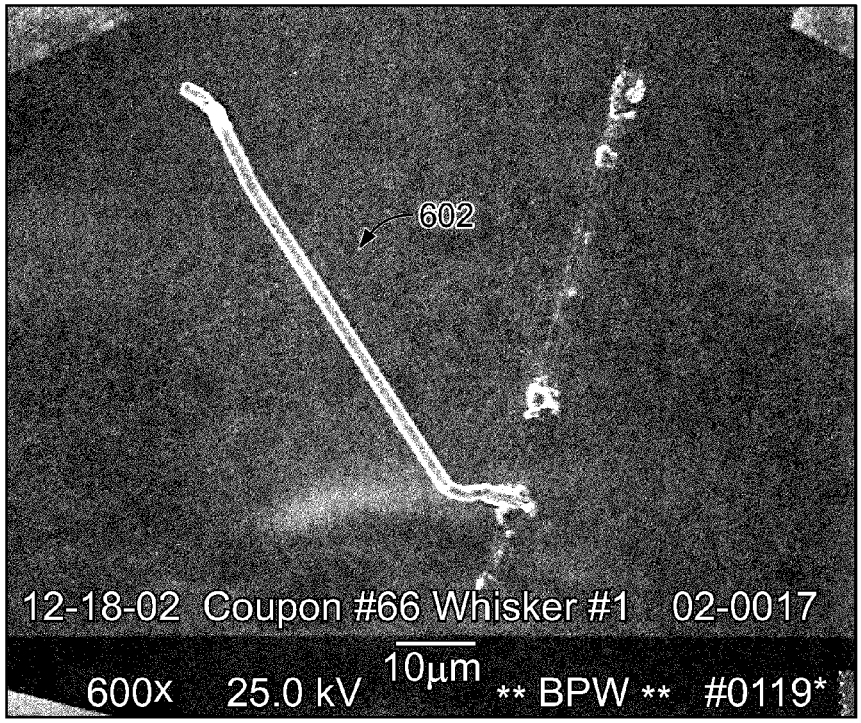
FIG. 6 is an image illustrating a tin whisker.
Figure 7:
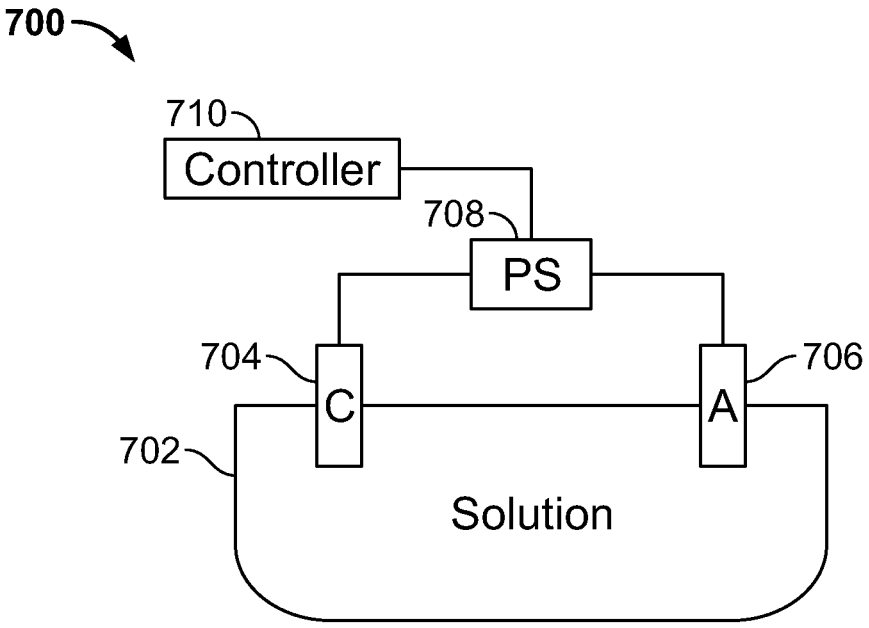
FIG. 7 is an illustration of an electroplating bath that may be used with one embodiment.

Thus, using various embodiments, tin antimony platings may be provided that reduce or eliminate tin whisker formation, such as the tin whisker 602 shown in the image 600 of FIG. 6.

Various embodiments may provide tin antimony plating using different plating methods. For example, plating may be performed using an electroplating bath 700 formed as described in more detail herein, such as by producing an electrolyte and adding an antimony solution to the electrolyte. Thus, the electroplating bath 700 may contain a solution 702 produced as described herein with a cathode 704 and anode 706 immersed in the solution 702 connected to a power supply 708 (which may be connected to a controller 710) and plating performed, such as on the cathode as described herein. Accordingly, a component, for example, an electronics component, such as one or more leads thereof, may be plated.

Thus, at least one embodiment provides an inexpensive and whisker resistant method for tin plating, such as may be used for tin plated electronic components that resist whisker formation after plating.

It should be noted that the various embodiments may be implemented in hardware, software or a combination thereof. The various embodiments and/or components, for example, the modules, or components and controllers therein, also may be implemented as part of one or more computers or processors. The computer or processor may include a computing device, an input device, a display unit and an interface, for example, for accessing the Internet. The computer or processor may include a microprocessor. The microprocessor may be connected to a communication bus. The computer or processor may also include a memory. The memory may include Random Access Memory (RAM) and Read Only Memory (ROM). The computer or processor further may include a storage device, which may be a hard disk drive or a removable storage drive such as a solid state drive, optical disk drive, and the like. The storage device may also be other similar means for loading computer programs or other instructions into the computer or processor.

As used herein, the term "computer" or "module" may include any processor-based or microprocessor-based system including systems using microcontrollers, reduced instruction set computers (RISC), ASICs, logic circuits, and any other circuit or processor capable of executing the functions described herein. The above examples are exemplary only, and are thus not intended to limit in any way the definition and/or meaning of the term "computer".

The computer or processor executes a set of instructions that are stored in one or more storage elements, in order to process input data. The storage elements may also store data or other information as desired or needed. The storage element may be in the form of an information source or a physical memory element within a processing machine.

The set of instructions may include various commands that instruct the computer or processor as a processing machine to perform specific operations such as the methods and processes of the various embodiments. The set of instructions may be in the form of a software program. The software may be in various forms such as system software or application software and which may be embodied as a tangible and non-transitory computer readable medium. Further, the software may be in the form of a collection of separate programs or modules, a program module within a larger program or a portion of a program module. The software also may include modular programming in the form of object-oriented programming. The processing of input data by the processing machine may be in response to operator commands, or in response to results of previous processing, or in response to a request made by another processing machine.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from the scope thereof. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

What is claimed is:

1. A plating method comprising:

heating a tin (Sn) plating solution to a first temperature between 70° C. and 80° C.;

forming an antimony-doped tin plating solution by adding an antimony (Sb)-containing solution to the tin (Sn) plating solution while maintaining the tin (Sn) plating solution at a second temperature that is different than the first temperature; and electroplating substrate with the antimony-doped tin plating solution to form an antimony-doped tin plating on the substrate, wherein the antimony-doped tin plating comprises 1% to 5% antimony by weight of the antimony-doped tin plating, wherein the antimony-doped tin plating reduces tin whisker compared to an undoped tin plating.

2. The plating method of claim 1, wherein the antimony-doped tin plating comprises 97.6% tin by weight of the antimony-doped tin plating.

3. The method of claim 1, wherein the second temperature at which the tin (Sn) plating solution is maintained is a temperature other than 75° C.

4. The method of claim 3, wherein the second temperature at which the tin (Sn) plating solution is maintained is above 75° C.

5. The method of claim 3, wherein the second temperature at which the tin (Sn) plating solution is maintained is below 75° C.

* * * * *